US006815013B2

(12) United States Patent
Iizawa et al.

(10) Patent No.: US 6,815,013 B2
(45) Date of Patent: Nov. 9, 2004

(54) GLASS LINING APPLICATION METHOD

(75) Inventors: Yoshihiro Iizawa, Saitama-ken (JP); Masahiro Shirasaki, Saitama-ken (JP); Jyunji Ono, Saitama-ken (JP)

(73) Assignee: Ikebukuro Horo Kogyo Co., Ltd., Saitama-ken (JP)

( * ) Notice: Subject to any disclaimer, the term of this patent is extended or adjusted under 35 U.S.C. 154(b) by 0 days.

(21) Appl. No.: 10/095,457

(22) Filed: Mar. 13, 2002

(65) Prior Publication Data

US 2003/0172678 A1 Sep. 18, 2003

(51) Int. Cl.[7] ..... C23C 4/08

(52) U.S. Cl. ..... 427/455; 427/456; 427/8; 65/59.5; 65/29.12; 65/29.14

(58) Field of Search ..... 427/8, 455, 456; 65/59.5, 29.12, 29.14

(56) References Cited

U.S. PATENT DOCUMENTS

| | | | | |
|---|---|---|---|---|
| 2,823,139 A | | 2/1958 | Schulze et al. | |
| 3,304,402 A | | 2/1967 | Thorpe | |
| 3,877,961 A | | 4/1975 | Tank et al. | |
| 4,077,637 A | | 3/1978 | Hyde et al. | |
| 4,273,824 A | | 6/1981 | McComas et al. | |
| 4,471,017 A | | 9/1984 | Poeschel et al. | |
| 6,348,232 B1 | * | 2/2002 | Chida et al. | 427/8 |

FOREIGN PATENT DOCUMENTS

| | | | |
|---|---|---|---|
| CH | 366 712 | | 2/1963 |
| DE | 40 21 466 | | 1/1992 |
| FR | 1043592 | | 11/1953 |
| FR | 2 495 503 | | 6/1982 |
| GB | 1 519 370 | | 7/1978 |
| GB | 2 121 780 | | 1/1984 |
| JP | 2-236266 | * | 9/1990 |
| JP | 2001-64762 | * | 3/2001 |

OTHER PUBLICATIONS

Abstract of JP2–236266, Sep. 1990.*
Abstract of JP–2001–64762, Mar. 2001.*
Database WPI, Section Ch, Week 199738, Derwent Publications Ltd., London, GB; AN 1993–040635, XP002213045 & JP 02 642536 B, Aug. 20, 1997.

* cited by examiner

*Primary Examiner*—Peter Chin
*Assistant Examiner*—Mark Halpern
(74) *Attorney, Agent, or Firm*—Wenderoth, Lind & Ponack, L.L.P.

(57) ABSTRACT

A new glass lining application method enables stable, uniform glass lining layers to be applied to large glass-lined instruments composed of a stainless base material, the method including forming a thermal spray treatment layer by applying a thermal spray treatment to a surface of a stainless base material using a thermal spray material selected from a group composed of a stainless material identical to the base material, Ni metal, Cr metal, Fe metal, Co metal, Ni—Cr alloys, and Fe—Cr alloys, then forming a glass lining layer on the thermal spray treatment layer by means of a glass lining heat treatment using a ground coat and a cover coat, a surface roughness Rz of the thermal spray treatment layer being within a range from 5 to 100 $\mu$m, and an open pore diameter being within a range from 3 to 60 $\mu$m.

4 Claims, 1 Drawing Sheet

GLASS LINING APPLICATION METHOD

BACKGROUND OF THE INVENTION

1. Field of the Invention

The present invention relates to a glass lining application method for glass-lined instruments having a stainless steel plate or casting as a base material capable of withstanding severe service conditions in the chemical industry, the pharmaceutical industry, the food industry, etc.

2. Description of the Related Art

In the firing of glass linings, a base metal must be an oxidizable metal so that a ground coat can adhere to the base metal firmly. Since stainless alloys are nonoxidizable, in the case of glass lining on stainless base materials, attempts have conventionally been made to roughen a surface of the stainless base material and increase bonding with the ground coat chemically by acid treatment of the surface during precleaning or by means of a physical sandblasting treatment.

Furthermore, in glass linings on stainless base materials, differences in the coefficients of linear thermal expansion of the stainless base materials (coefficients of linear thermal expansion equal to or greater than $165\times10^{-7}$° C.$^{-1}$ at 100 to 400° C.) and glasses (coefficients of linear thermal expansion of 95 to $100\times10^{-7}$° C.$^{-1}$ at 100 to 400° C.) are large, and residual compression stresses after the firing process due to differences in cooling contraction are great, giving rise to the occurrence of shearing stresses from the stainless base material to the glass lining layer, whereby delamination of the glass lining layer often occurs.

In order to solve problems such as that described above when applying a glass lining to a stainless base material, Japanese Patent No. 2642536, for example, discloses a glass lining application method in which a thermal spray treatment is applied to a surface of a stainless base material using a thermal spray material selected from a group composed of a stainless material identical to the base material, Ni metal, Cr metal, Fe metal, Co metal, Ni—Cr alloys, and Fe—Cr alloys, and then glass lining is performed by means of a heat treatment, the glass lining application method being characterized in that a total glass lining thickness is within a range from 600 $\mu$m to 2500 $\mu$m, and a ratio between a thermal spray treatment layer thickness and the glass lining layer thickness is within a range from 1:10 to 1:200. Bond strength between the stainless base material and the ground coat layer can be ensured to a certain extent by the glass lining application method according to this patent, enabling a glass lining structure having superior glass lining delamination resistance to be provided.

However, since plasma spray treatments at the time when the above patent was invented involved an operator manually securing the base material and spraying a thermal spray gun, the only possible parameter for increasing bond strength and suppressing delamination of the glass lining in the thermal spray treatment using a thermal spray material on stainless base materials in large shapes was to perform an operation such as regulating the ratio between the thermal spray treatment layer thickness and the glass lining layer thickness as described above during the thermal spray treatment using a thermal spray material on the stainless base material and during subsequent formation of the glass lining layer by means of a ground coat and cover coat.

However, in conventional manual plasma spray treatments, the temperature of the thermal spray formed by an arc discharge is approximately 10,000° C. and the globule temperature of the thermal spray material is only around 3,000 to 4,000° C., making the grains in the globules of the thermal spray material coarse, thereby making it difficult to form a uniform thermal spray treatment layer on stainless base materials in large shapes. In other words, if the thermal spray material adheres to the stainless base material surface before globule formation and size reduction can progress sufficiently, the resulting thermal spray treatment layer may be locally thickened, the surface of the thermal spray treatment layer may be coarse, or an open pore diameter of the thermal spray treatment layer surface may be abnormally large, exceeding 100 $\mu$m, and the present inventors found by means of subsequent experiments with actual specimens having large shapes that there was a possibility that problems such as bubbles being generated in the glass lining layer or bond strength between the ground coat layer and the stainless base material deteriorating would arise if a glass lining is applied to a thermal spray material layer of this kind. In other words, it was found that when applying glass linings to stainless base materials in large shapes, there are cases when it is insufficient merely to control the ratio between the thermal spray treatment layer thickness and the glass lining layer thickness.

SUMMARY OF THE INVENTION

Consequently, an object of the present invention is to provide a new glass lining application method enabling stable, uniform glass lining layers to be applied to large glass-lined instruments composed of a stainless base material.

Remarkable progress in thermal spray treatment techniques has been accomplished in recent years, and automated (robotized) plasma thermal spraying techniques constitute the mainstream. According to this thermal spraying technique, thermal spray temperatures in excess of 10,000° C. are achieved by means of an arc discharge, and globule temperatures have also risen to 5,000 to 6,000° C. therewith, enabling thermal spray material to be formed into globules, reduced in size, accelerated, and ejected in a high-temperature range. The present inventors have applied this thermal spraying technique to the thermal spraying of stainless base materials in large shapes, and have found therewith that the technique is effective for applying stable, uniform glass lining layers to glass-lined instruments composed of stainless base materials in large shapes if surface roughness of a thermal spray treatment layer, open pore diameter, and bond strength between a ground coat layer and the thermal spray-treated stainless base material are kept within certain ranges by controlling the surface characteristics of a thermal spray treatment layer formed thereon.

According to one aspect of the present invention, there is provided a glass lining application method including forming a thermal spray treatment layer by applying a thermal spray treatment to a surface of a stainless base material using a thermal spray material selected from a group composed of a stainless material identical to the base material, Ni metal, Cr metal, Fe metal, Co metal, Ni—Cr alloys, and Fe—Cr alloys, then forming a glass lining layer on the thermal spray treatment layer by means of a glass lining heat treatment using a ground coat and a cover coat, wherein:

a surface roughness Rz of the thermal spray treatment layer is within a range from 5 to 100 $\mu$m; and an open pore diameter is within a range from 3 to 60 $\mu$m.

A bond strength between the thermal spray-treated stainless base material and the ground coat glass lining layer may be equal to or greater than 250 N/cm$^2$ (2.5 MPa).

A thickness of the glass lining layer may be within a range from 600 μm to 2500 μm.

A thickness of the thermal spray treatment layer and a thickness of the glass lining layer may be within a range from 1:10 to 1:200.

DETAILED DESCRIPTION OF THE PREFERRED EMBODIMENT

Figure 1A:
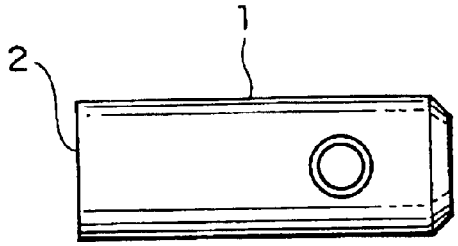
FIGS. 1A and 1B explain a method for measuring bond strength between a thermal spray-treated stainless base material and a ground coat glass lining layer.

The technique forming the basis of a glass lining application method according to the present invention involves applying a thermal spray treatment to a surface of a stainless base material using a metal thermal spray material in a similar manner to Japanese Patent No. 2642536 above. By disposing a thermal spray treatment layer on the stainless base material surface, the shortcoming in which a glass lining layer delaminates due to differences in cooling contraction of the glass lining layer and the stainless base material during subsequent application of a glass lining layer is eliminated, achieving ample bond strength. Furthermore, the thermal spray treatment layer on the stainless base material surface can prevent delamination of the glass lining layer by reducing foaming by an oxidation reaction between a ground coat and a stainless base material such as occurs in a conventional glass lining, thereby alleviating residual stresses arising after the firing of the glass lining.

Here, for example, stainless metals such as SUS-316, SUS-304, SUS-430, etc., can be used for the stainless base material. Furthermore, in addition to the above stainless metals, Ni, Cr, Fe, or Co metals, or Ni—Cr alloys, Fe—Cr alloys, etc., can be used for the metal spray material.

In the glass lining application method according to the present invention, a plasma spray treatment apparatus used to form the thermal spray treatment layer is ideal if it is an automated (robotized) type achieving a thermal spray temperature over 10,000° C. by means of an arc discharge, has a globule temperature within a range from 5,000 to 6,000° C., and is capable of forming the thermal spray material into globules, reducing the size of the globules, and accelerating and ejecting the thermal spray material. By using an apparatus of this type, it is possible to suitably control surface characteristics (surface roughness Rz, open pore diameter, etc.) of the thermal spray treatment layer when performing the thermal spray treatment on surfaces of stainless base materials in large shapes. Here, the thermal spray gas used is not limited to any particular type and any commonly-used thermal spray gas can be used, but is preferable that an Ar/He gas mixture be used. Moreover, the above type of apparatus is ideal for performing the thermal spray treatment on stainless base material surfaces in large shapes, but the glass lining application method according to the present invention is not limited to the above type of apparatus, and of course other types of conventional thermal spray apparatus can be used provided that they can control the surface characteristics (surface roughness Rz, open pore diameter, etc.) of the thermal spray treatment layer taking into account the shape, size, etc., of the stainless base material.

In the glass lining application method according to the present invention, the surface roughness (Rz) of the thermal spray treatment layer is an average value of five repeated measurements in each of which the surface of the thermal spray treatment layer formed on the stainless base material is measured at a sampling length of 0.8 mm (800 μm), measuring the length from the top of the highest peak to the bottom of the lowest valley, using a tracer-type roughness gage (SATRONIC 10, manufactured by Yamatake & Co., Ltd., for example). Here, Rz should be within a range from 5 to 100 μm, preferably 10 to 80 μm, even more preferably 15 to 60 μm. It is undesirable for Rz to be less than 5 μm, since bond strength with the stainless base material is then inferior, and it is undesirable for Rz to be greater than 100 μm, since bubbles then form during application of the glass lining.

The open pore diameter of the surface of the thermal spray treatment layer is obtained by observing the thermal spray treatment layer surface visually with an electron microscope and measuring the diameter of the open pores on the surface of the thermal spray treatment layer. Here, the open pore diameter should be within a range from 3 to 60 μm, preferably 5 to 40 μm, even more preferably 10 to 30 μm. It is undesirable for the open pore diameter to be less than 3 μm, since bond strength with the stainless base material is then inferior, and it is undesirable for the open pore diameter to be greater than 60 μm, since bubbles then form during application of the glass lining.

Figure 1B:
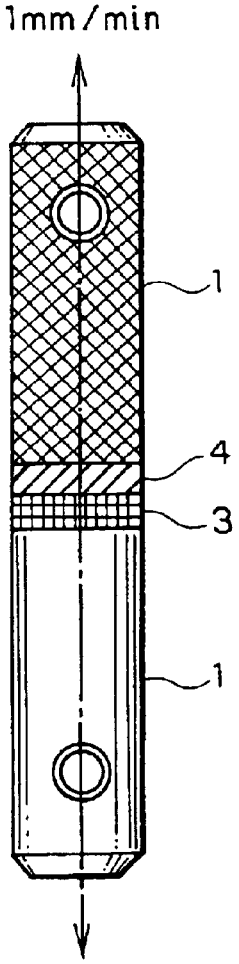

The bond strength between the thermal spray-treated stainless base material and the ground coat glass lining layer was obtained by the following operation:

- a thermal spray treatment is performed on a cross section (2) of a round bar (1) having a diameter of 20 mm and a length of 45 mm composed of a stainless base material having the shape show in FIG. 1A;
- a ground coat glass lining layer (4) is formed by applying a ground coat by a conventional method on a resulting thermal spray treatment layer (3); and then a round bar having a similar shape is bonded thereto using an adhesive as shown in FIG. 1B.

Next, the resulting test piece was pulled at a speed of 1 mm per minute in the directions shown in FIG. 1B using a tension tester (Model 462 manufactured by Tester Sangyo Co., Ltd, for example), and the value of the tensile force at the instant when the thermal spray treatment layer and the ground coat glass lining layer delaminated divided by the area of the cross section (1) was taken as the bond strength ($N/cm^2$)/(MPa). Here, the bond strength between the thermal spray-treated stainless base material and the ground coat glass lining layer should be equal to or greater than 250 $N/cm^2$ (2.5 MPa), preferably equal to or greater than 300 $N/cm^2$ (3.0 MPa). It is undesirable for the bond strength between the thermal spray-treated stainless base material and the ground coat glass lining layer to be less than 250 $N/cm^2$ (2.5 MPa), since the bonding strength with the stainless base material is then insufficient, increasing the likelihood of delamination after application of the glass lining.

Moreover, in the glass lining application method according to the present invention, the thickness of the glass lining layer can be selected arbitrarily within a range from 600 to 2500 μm prescribed by the Japanese Industrial Standards (JIS). The thickness of the thermal spray treatment layer should be within a range from 10 to 250 μm, preferably 10 to 100 μm. It is undesirable for the thickness of the thermal spray treatment layer to be less than 10 μm, since residual stress alleviating effects are then poor. It is undesirable for the thickness of the thermal spray treatment layer to exceed 250 μm, since the thermal spray treatment layer then assumes a laminated structure, increasing the occurrence of outgassing during the firing of the glass lining.

The ratio between the thermal spray treatment layer thickness and the glass lining layer thickness should be within a range from 1:10 to 1:200, preferably 1:10 to 1:83. Here, it is undesirable for this ratio to be less than 1:10, since the thermal spray treatment layer thickness is then too thick relative to the glass lining layer thickness, and gas cavities in the thermal spray treatment layer arising with the laminated structure become problematic and remain as air gaps because the ground coat cannot penetrate inside the gas cavities in the thermal spray treatment layer in the glass lining firing process, giving rise to a reduction in strength as a glass lining structure, which may lead to delamination of the glass lining. It is also undesirable for this ratio to exceed 1:200, since the thermal spray treatment layer is then thin, making bond strength with the stainless base material inferior.

Moreover, conventional ground coat and cover coat glass lining frit compositions can be used in the glass lining application method according to the present invention. These glass lining frit compositions are not limited to a particular type and any type can be used provided that it is composed of components selected from a group composed of $SiO_2$, $B_2O_3$, $Al_2O_3$, CaO, MgO, $Na_2O$, CoO, NiO, $MnO_2$, $K_2O$, $Li_2O$, BaO, ZnO, $TiO_2$, $ZrO_2$, $F_2$, etc.

The glass lining application method according to the present invention exhibits effects enabling a stable, homogeneous glass lining layer to be applied to glass-lined instruments composed of stainless base materials in large shapes.

EXAMPLES

The compositions of the ground coat and the cover coat used in the inventive examples and the comparative example are described in Table 1 below:

TABLE 1

| | | Ground coat | Cover coat |
|---|---|---|---|
| Mixture (% by weight) | $SiO_2 + TiO_2 + ZrO_2$ | 41 | 61 |
| | $R_2O(Na_2CO_3 + K_2CO_3 + Li_2CO_2)$ | 25 | 23 |
| | $R'O(CaCO_3 + BaCO_3 + MgCO_3 + ZnCO_3)$ | 11 | 9 |
| | $H_3BO_3 + Al_2O_2$ | 21 | 6 |
| | $CoO + NiO + MnCO_3$ | 2 | 1 |
| Composition (% by mole) | $SiO_2 + TiO_2 + ZrO_2$ | 55 | 73 |
| | $R_2O(Na_2O + K_2O + Li_2O)$ | 21 | 17 |
| | $R'O(CaO + BaO + MgO + ZnO)$ | 6 | 5 |
| | $B_2O_3 + Al_2O_3$ | 15.5 | 4 |
| | $CoO + NiO + MnO$ | 2.5 | 1 |

Inventive Example 1

A thermal spray treatment layer having a thickness of 20 to 40 μm was obtained using a 8,000-liter reaction vessel cover composed of SUS-316 having a diameter of 2,200 mm and a thickness of 19 mm as a base material by thermal spraying SUS-430 onto an inner surface thereof by means of a robotic plasma spray apparatus (thermal spray gas: Ar/He gas mixture; thermal spray temperature: over 10,000° C.; globule temperature: 5,000 to 6,000° C.).

The surface roughness Rz of the resulting thermal spray treatment layer was 20 μm, and the open pore diameter was within a range from 5 to 20 μm.

Next, the ground coat frit in Table 1 was pulverized in a dry ball mill, prepared into a slip by mixing the frit powder having a grain size adjusted to 5 g/200 mesh sieve/50 g with an 0.15-percent-by-mass CMC (carboxymethyl cellulose) aqueous solution and an organic solvent (an alcohol) at a mass ratio of 1:0.2:0.1, and was then applied wet using a spray gun. Thereafter, the ground coat was dried for approximately three hours using a fan, and was fired in a kiln at 880° C. for 70 minutes.

The thickness of the ground coat glass lining layer obtained after firing was 200 to 300 μm, and a homogeneous ground coat glass lining layer was obtained without any bubbles being generated in the ground coat glass lining layer over the entire inside of the reaction vessel cover.

Next, the cover coat frit in Table 1 was prepared into a slip with a grain size identical to that of the ground coat frit, was applied by spray gun in a similar manner to the ground coat slip, and after drying, was fired in a kiln at 800° C. for 100 minutes.

An overall glass lining layer thickness of 1,000 to 1,600 μm was obtained by repeating a similar operation to the application of the cover coat frit three times. A homogeneous glass lining layer was able to be formed without any occurrence of bubbles or delamination being observed in the resulting glass lining layer.

Next, a thermal spray treatment layer was formed on the cross section (1) of a round bar composed of SUS-316 as shown in FIG. 1A under similar conditions to those above, and then a ground coat was applied and a ground coat glass lining layer having a thickness of 200 to 300 μm was obtained by firing at 860° C. for 20 minutes.

Next, the ground coat glass lining layer and the cross section of another round bar composed of SUS-316 were bonded using an epoxy resin as the adhesive, as shown in FIG. 1B, and when the bond strength was measured using the Model 462 tension tester manufactured by Tester Sangyo Co., Ltd., the bond strength between the thermal spray-treated stainless base material and the ground coat glass lining layer was 440 $N/cm^2$ (4.4 MPa).

Inventive Example 2

A glass lining layer was formed on a reaction vessel cover in a similar manner to Inventive Example 1 except that the thermal spray treatment layer was formed by thermal spraying SUS-430 to a thickness of 70 to 100 μm. The surface roughness Rz of the thermal spray treatment layer was 20 μm, and the open pore diameter was 5 to 20 μm. A homogeneous glass lining layer was able to be formed without any occurrence of bubbles or delamination being observed in the resulting glass lining layer.

Furthermore, the bond strength measured by an operation similar to that of Inventive Example 1 was 440 $N/cm^2$ (4.4 MPa).

Inventive Example 3

A glass lining layer was formed on a reaction vessel cover in a similar manner to Inventive Example 1 except that the thermal spray treatment layer was formed by thermal spraying Ni to a thickness of 40 to 70 μm. The surface roughness Rz of the thermal spray treatment layer was 35 μm, and the open pore diameter was 10 to 30 μm. A homogeneous glass lining layer was able to be formed without any occurrence of bubbles or delamination being observed in the resulting glass lining layer.

Furthermore, the bond strength measured by an operation similar to that of Inventive Example 1 was 310 $N/cm^2$ (3.1 MPa).

Inventive Example 4

A glass lining layer was formed on a reaction vessel cover in a similar manner to Inventive Example 1 except that the thermal spray treatment layer was formed by thermal spraying Cr to a thickness of 40 to 70 μm. The surface roughness Rz of the thermal spray treatment layer was 35 μm, and the open pore diameter was 10 to 30 μm. A homogeneous glass lining layer was able to be formed without any occurrence of bubbles or delamination being observed in the resulting glass lining layer.

Furthermore, the bond strength measured by an operation similar to that of Inventive Example 1 was 330 $N/cm^2$ (3.3 MPa).

Comparative Example 1

A thermal spray treatment layer having a thickness of 10 to 100 μm was obtained using a reaction vessel cover having a shape similar to that of Inventive Example 1 as a base material by thermal spraying SUS-430 onto an inner surface thereof by means of a hand-held plasma spray gun (thermal spray gas: $N_2/H_2$ gas mixture; thermal spray temperature: 10,000° C. or less; globule temperature: 2,000 to 3,000° C.).

The surface roughness Rz of the resulting thermal spray treatment layer was 80 μm, and the open pore diameter was within a range from 10 to 80 μm. In addition, coarse protrusions of indeterminate size having a diameter of 200 to 300 μm resulting from thermal spraying were observed at intervals of approximately 10 cm.

Next, a ground coat glass lining layer having a thickness of 200 to 300 μm was obtained using a method similar to that of Inventive Example 1 by applying, drying, then firing the ground coat frit in a kiln at 870° C. for 70 minutes. However, large bubbles having a diameter more than 100 μm were generated in the glass lining layer, and in addition, the thermal spray treatment layer protruded locally, and a uniform ground coat glass lining layer was not able to be obtained.

What is claimed is:

1. A glass lining application method comprising forming a plasma spray treatment layer by applying a plasma spray treatment using an automated plasma thermal spraying technique to a surface of a stainless base material using a plasma spray material selected from the group consisting of a stainless material identical to said base material, Ni metal, Cr metal, Fe metal, Co metal, Ni—Cr alloys, and Fe—Cr alloys, then forming a glass lining layer on said plasma spray treatment layer by means of a glass lining heat treatment using a ground coat and a cover coat, wherein:

a surface roughness Rz of said plasma spray treatment layer is within a range from 5 to 100 μm; and an open pore diameter of said plasma spray treatment layer is within a range from 3 to 60 μm.

2. The glass lining application method according to claim 1, wherein a bond strength between said plasma spray-treated stainless base material and said ground coat glass lining layer is equal to or greater than 250 N/cm2 (2.5 MPa).

3. The glass lining application method according to claim 1, wherein a thickness of said glass lining layer is within a range from 600 μm to 2500 μm.

4. The glass lining application method according to claim 1, wherein a ratio between a thickness of said plasma spray treatment layer and a thickness of said glass lining layer is within a range from 1:10 to 1:200.

* * * * *